US011613903B2

(12) United States Patent
Kelley

(10) Patent No.: US 11,613,903 B2
(45) Date of Patent: Mar. 28, 2023

(54) METHODS, APPARATUSES AND SYSTEMS FOR ANCHORING UMBRELLAS AND CANOPIES

(71) Applicant: Thomas Jeffrey Kelley, Del Mar, CA (US)

(72) Inventor: Thomas Jeffrey Kelley, Del Mar, CA (US)

( * ) Notice: Subject to any disclaimer, the term of this patent is extended or adjusted under 35 U.S.C. 154(b) by 0 days.

(21) Appl. No.: 17/131,075

(22) Filed: Dec. 22, 2020

(65) Prior Publication Data

US 2022/0195748 A1 Jun. 23, 2022

(51) Int. Cl.
*A45B 23/00* (2006.01)
*E04H 12/20* (2006.01)

(52) U.S. Cl.
CPC ..... *E04H 12/20* (2013.01); *A45B 23/00* (2013.01); *A45B 2023/0012* (2013.01)

(58) Field of Classification Search
CPC ..... A45B 2023/0012; A45B 2025/003; E04H 15/32
See application file for complete search history.

(56) References Cited

U.S. PATENT DOCUMENTS 4,924,893 A * 5/1990 Furey ..... A45B 23/00 135/16
5,461,833 A * 10/1995 Murray ..... E02D 5/74 248/156
6,964,277 B2 * 11/2005 Naber ..... A45B 25/00 135/117
8,783,274 B1 * 7/2014 Supino ..... A47G 25/12 135/16
9,482,024 B2 * 11/2016 Mallookis ..... E04H 15/62
10,190,330 B2 * 1/2019 Barnes ..... E04H 15/32
10,753,115 B2 * 8/2020 Perreault ..... A45B 25/00
2002/0026890 A1 * 3/2002 Zook ..... B63B 21/29 114/294
2004/0089332 A1 * 5/2004 Mandel ..... A45B 25/22 135/16
2019/0216187 A1 * 7/2019 Van Vollenhoven .. A45B 25/18

* cited by examiner

*Primary Examiner* — Noah Chandler Hawk
(74) *Attorney, Agent, or Firm* — Michael P. Eddy

(57) ABSTRACT

A beach umbrella anchoring system including an anchor member container, in the form of a cylindrical beach umbrella carrying bag, for containing a weighting medium, such as sand or water, and a connector for connecting the container to a beach umbrella restraining device; and a beach umbrella restraining device including a flexible cable member, a releasable connector fixed to one end of the cable for releasably connecting the cable to a beach umbrella, a second releasable connector, fixed to the other end of the cable, for releasably connecting the cable member to the anchor member, and a third releasable connector, attached to the anchor member for releasably attaching to the ground. The anchoring system may be supplied in the form of a kit comprising the anchoring member (beach bag), umbrella and the restraining device.

16 Claims, 3 Drawing Sheets

METHODS, APPARATUSES AND SYSTEMS FOR ANCHORING UMBRELLAS AND CANOPIES

CROSS-REFERENCES TO RELATED PATENT APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

Embodiments of the inventive subject matter relate to systems, apparatuses and methods relating for anchoring beach umbrellas, canopies and other similar portable coverings.

SUMMARY

The illustrative embodiments provide for apparatuses, systems and methods for anchoring a beach umbrella.

An objective of the inventive subject matter is to provide novel apparatuses, systems and methods that utilize a portable bag or container as an anchor with one or more straps to connect to one or portions on a beach umbrella. The straps can also be used as shoulder straps to help carry the portable bag or container. The embodiments can be used with a number of different beach umbrellas, umbrellas and canopies. For example, one bag may be used to transport a portable beach umbrella and then used with the straps to anchor a deployed or standing upright beach umbrella. In these embodiments, the one or more straps are connected to one or more points on the beach umbrella using one of more releasable fasteners.

DETAILED DESCRIPTION OF THE DRAWINGS

Figure 1:
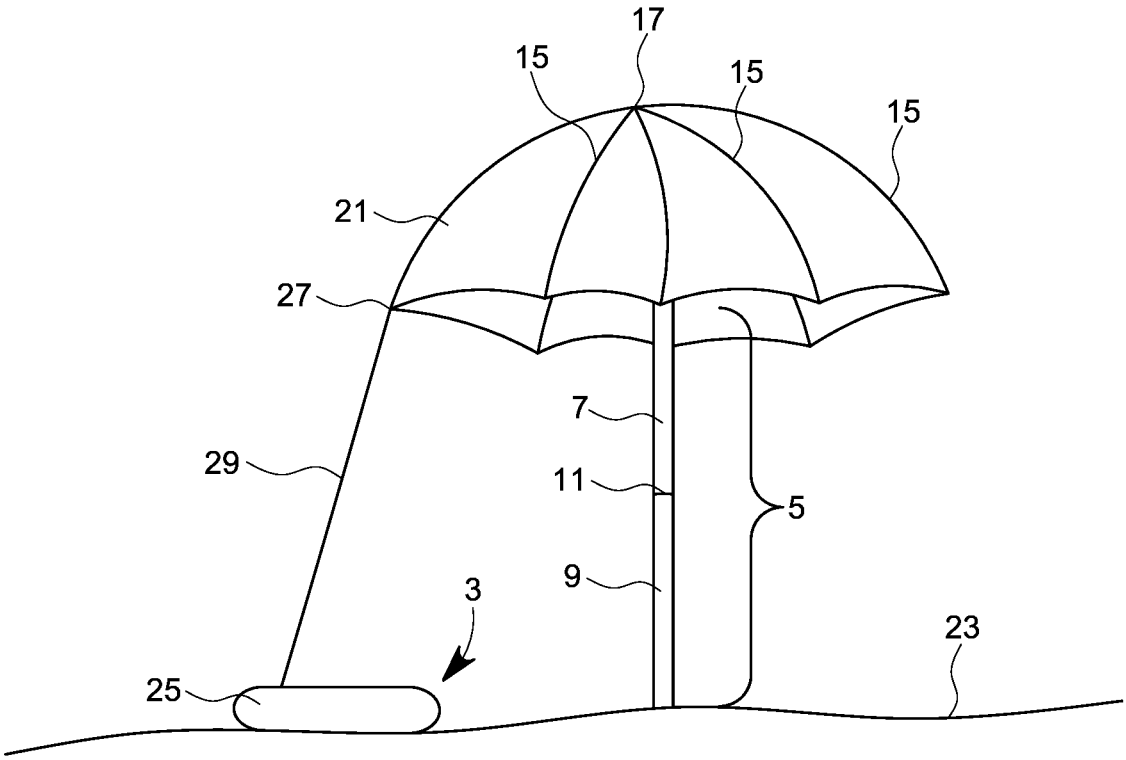
Figure 2:
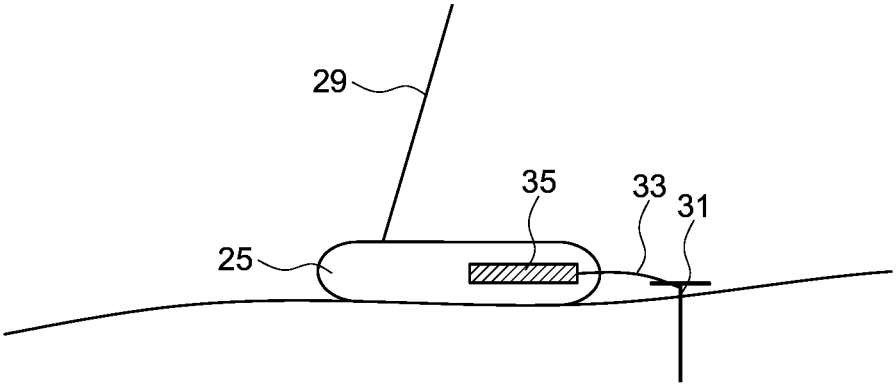
Figure 3:
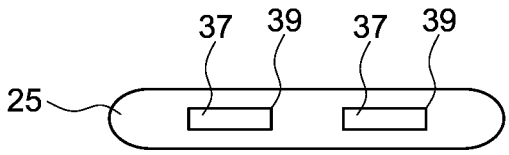

The novel features of the inventive subject matter, both as to its structure and its operation, will be best understood from the accompanying drawings, taken in conjunction with the accompanying description, in which the principles of the disclosure are utilized, of which:

FIG. 1 illustrates a beach umbrella with an anchoring system according to embodiments of the claimed subject matter; and FIG. 2 illustrates an anchor according to embodiments of the claimed subject matter; and FIG. 3 illustrates a container with two external storage pockets with fasteners according to embodiments of the claimed subject matter.

DETAILED DESCRIPTION

Turning now to the figures, FIG. 1 illustrates an embodiment that allows a user to attach the embodiments to a beach umbrella. FIG. 1 illustrates an exemplary beach umbrella, generally indicated as 1, and the anchoring system, generally indicated as 3. FIG. 2 illustrates an embodiment of the anchor 3.

In many embodiments, the beach umbrella comprises a support shaft 5 which is formed of an upper section 7 and a lower section 9, and these sections 7 and 9 may be interconnected through a joint 11 so as to allow disassembly and ease of positioning and transportation. In other embodiments, the support shaft 5 is one contiguous section. As shown the embodiment illustrated in FIG. 1, the support shaft 5 includes both lower section 9 and an upper section 7.

In these embodiments, the upper section 7 at its upper end (not shown) has a plurality of ribs 15 pivotally connected thereto so that the top 17 of the umbrella 1 is secured by the support shaft 5. A sliding element (not shown) may be releasably locked in an upper position whereby the ribs 15 are extended in a radial manner from the support shaft 5. A fabric cover 21 is shown supported by the ribs 15.

The lower section 9 of the support shaft 5 has a sharply tapered lower end so as to allow easy penetration of the ground 23 wherein the support shaft 5 may be inserted into the ground to provide a relatively stable structure. As with many unsecured beach umbrellas, unexpected gusts of wind or gusts of wind with greater force than expected may cause the umbrella 1 to topple or, even more dangerously, allow the umbrella to topple with the tapered end of the support shaft 5 flailing about. In order to prevent this, the umbrella 1, as shown in FIG. 1, is fitted with the anchoring system 3 comprising an anchor member 25 and a restraining element 27.

The releasable connector 27 connects the flexible cord 29 to the umbrella 1. The flexible cord 29 may also serve as the strap, rope, cable, or similar fastening element for the beach umbrella carrying bag. In many embodiments, the flexible cord 29 is constructed of a vinyl polymer, nylon or polyurethane material or any combination of those materials. It may also be constructed of any suitable material known to those skilled in the art including non-flexible materials. In many embodiments, the flexible cord 29 is constructed of nylon material or a nylon blend material. A releasable connector 27 is attached to one end of the cord 29 so it can be releasably attached to both the flexible cord 29 and the beach umbrella 1. In other embodiments the releasable connector 27 is permanently attached to one end of the cord 29.

A second releasable connector can be used at the opposite end of the cord 29 so it can be used to releasably attach flexible cord 29 to the anchor member 25. In many embodiments, the anchor member 25 of anchor 3 can be constructed as a bag which can be filled with sand or dirt.

In many embodiments, a spike 31 which can be a spike, stake, or similar sharp pointed implement is used to secure the anchor member 25 to the ground or any other suitable surface such as a rock or boulder. In some embodiments, the spike 31 can be a non sharp implement such as a clamp for clamping on to another object. In these embodiments, the spike 31 is attached to the container with a string 33 or other similar attachment element so that it can be secured into the ground in order to hold the container 25 in place. In some embodiments, more than one spike may be used to fasten the container to the ground. Also in many embodiments, the spike is attached to a zipper 35 and the zipper opens and closes a compartment within the container (not shown) that is used to hold the one or more spikes 31 when they are not in use securing the container 25 to the ground or another object.

In many of the embodiments, the container 25 may be constructed of one or more sized containers each of which may be of any suitable size. The one or more containers 25 may also be removably connected with one or more of the containers 25 using any suitable fastener. Embodiments can also include one or more containers 25 with a zipper or other type of suitable fastener with a suitable length so as to allow the opening and closing of a pocket on the interior the container 25. FIG. 3 illustrated two pockets 37 and two fasteners 39 positioned on the exterior of a container 25. Other embodiments include one or more pockets positioned on the interior of the container 25 (not shown). In some embodiments, one or more surfaces of the interior or exterior pockets can be constructed of a mesh material. Any other suitable material may also be used in the one or more interior and exterior pockets. Additionally, any suitable fastener may also be used instead or in conjunction with a zipper closure, for example hook and loop fastener, and any suitable number of fasteners may be used to allow the one or more exterior pockets to be opened and closed as needed.

While the present embodiments have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure. It is intended that the disclosure covers methods and structures within the scope of these claimed subject matter and their equivalents disclosed herein.

What is claimed is:

1. A beach umbrella restraining device comprising:

a beach umbrella with an upper surface and a support shaft;

an anchor member constructed of a tubular shaped bag;

a flexible, longitudinally extending cord member, said longitudinally extending cord member having a first end and a second end;

a first releasable fastener connected to said first end of said longitudinally extending cord member for releasably attaching said longitudinally extending cord member to a surface of the beach umbrella when the beach umbrella is positioned in an upright position;

a second releasable fastener connected to the second end of said longitudinally extending cord member for releasably attaching said longitudinally extending cord member to a surface of the anchor member for anchoring said beach umbrella; and a spike attached with a second cord member to the anchor member wherein the spike can be secured to another surface for holding the anchor member in place;

wherein said longitudinally extending cord member can be releasably attached to the ends of the anchor member so that the longitudinally extending cord member can be used as a carrying strap for the anchor member.

2. The beach umbrella restraining device of claim 1 wherein the first releasable fastener is connectably engageable to an edge of the beach umbrella upper surface.

3. A beach umbrella anchoring system comprising:

a beach umbrella;

a container for containing an amount of removable weighted medium;

a flexible, longitudinally extending cord member, said cord member having a first end and a second end;

a first releasable attachment fixture positioned on the first end of said cord member for releasably attaching the cord member to a surface of the beach umbrella;

a second releasable attachment fixture positioned on the second end of the cord member for releasably attaching the cord member to a surface of the container;

a spike fastened to the container with a third cord so that the spike can be secured to the ground in order to hold the container in place.

4. The beach umbrella anchoring system of claim 3 further comprising a third releasable attachment fixture for releasably attaching the cord member to the surface of a beach umbrella support shaft.

5. The beach umbrella anchoring system according of claim 4, wherein said third releasable attachment fixture is adjustably attached to said third cord member so that said third releasable attachment fixture can be moved along the first and second ends of said third cord member.

6. The beach umbrella anchoring system according to claim 3, wherein said first releasable attachment fixture is connectably engageable with said beach umbrella support.

7. The beach umbrella anchoring system according to claim 3, wherein said first releasable attachment fixture further comprises a friction element connected to said longitudinally extending cord member to prevent said first releasable attachment fixture from sliding longitudinally along said longitudinally extending cord member.

8. The beach umbrella anchoring system according to claim 3, wherein said second releasable attachment fixture further comprises a friction element that is adjustably connected to said longitudinally extending cord member so that the second releasable attachment fixture can move along the first and second ends longitudinally extending cord member.

9. The beach umbrella anchoring system according to claim 3, wherein said container comprises a substantially planar base member having a peripheral edge and at least one upstanding peripheral wall in contact with and attached to said peripheral edge of said base member and with at least one upstanding peripheral wall cooperating to form an open-ended container.

10. The beach umbrella anchoring system according to claim 3, wherein said container is constructed substantially of a cylindrical shape with at least one openable end.

11. The beach umbrella anchoring system according to claim 3, wherein said removable weighted medium is sand.

12. The beach umbrella anchoring system according to claim 3, further comprising one or more storage pockets positioned on the outward surface of the container wherein the one or more pockets are openable and closable with one or more fasteners.

13. The beach umbrella anchoring system according to claim 3, further comprising one or more storage pockets positioned on the interior surface of the container wherein the one or more pockets are openable and closable with one or more fasteners.

14. A beach umbrella anchor kit comprising:

a beach umbrella;

an anchor member comprising:

a container means for containing an amount of removable weighted medium;

a removably attachable connector for connecting said container to a beach umbrella restraining device;

wherein said beach umbrella restraining device comprises:

a flexible, longitudinally extending cord member, said cord member having a first end and a second end;

a first releasable attachment fixture for attaching to said first end of said cord member for releasably attaching said cord member to a beach umbrella, a second releasable attachment fixture for attaching said second end of said cord member for releasably attaching said cord member to said removably attachable connector; and a spike attached to the container with a third cord so that the spike can be secured to the ground for holding the container in a fixed position.

15. The beach umbrella anchor kit of claim 14 further comprising:

a third releasable attachment fixture attached to said cable member in a position intermediate to said first and said second ends, for releasably attaching said cable member to said beach umbrella.

16. The beach umbrella anchor kit of claim 14 wherein said beach umbrella is a canopy.

* * * * *